US007784433B2

(12) United States Patent
Birk

(10) Patent No.: US 7,784,433 B2
(45) Date of Patent: Aug. 31, 2010

(54) HEAT EXCHANGER FOR COOLING REACTION GAS

(75) Inventor: Carsten Birk, Berlin (DE)

(73) Assignee: BORSIG GmbH (DE)

( * ) Notice: Subject to any disclaimer, the term of this patent is extended or adjusted under 35 U.S.C. 154(b) by 464 days.

(21) Appl. No.: 11/943,140

(22) Filed: Nov. 20, 2007

(65) Prior Publication Data

US 2008/0121383 A1 May 29, 2008

(30) Foreign Application Priority Data

Nov. 24, 2006 (DE) ..... 10 2006 055 973

(51) Int. Cl.
*F22F 9/22* (2006.01)

(52) U.S. Cl. ..... 122/31.1; 122/7 R; 165/145

(58) Field of Classification Search ..... 122/31.1, 122/7 R, 235.17, 238, 367.1, 62, 136; 165/145, 165/101

See application file for complete search history.

(56) References Cited

U.S. PATENT DOCUMENTS

| | | | | |
|---|---|---|---|---|
| 4,296,088 | A * | 10/1981 | Stauffer | 423/533 |
| 4,488,513 | A * | 12/1984 | Jahnke et al. | 122/32 |
| 4,561,496 | A * | 12/1985 | Kehrer | 165/103 |
| 4,643,747 | A * | 2/1987 | Becker | 55/434.4 |
| 5,031,692 | A * | 7/1991 | Kehrer et al. | 165/134.1 |
| 5,813,453 | A * | 9/1998 | Brucher | 165/134.1 |
| 5,852,990 | A * | 12/1998 | Primdahl | 122/7 R |
| 6,155,337 | A | 12/2000 | Rosengarten | |
| 6,435,139 | B1 * | 8/2002 | Brucher | 122/7 R |
| 7,036,461 | B2 * | 5/2006 | Thielert et al. | 122/7 R |
| 7,090,816 | B2 * | 8/2006 | Malhotra et al. | 423/359 |
| 7,412,945 | B2 * | 8/2008 | Jekerle et al. | 122/7 R |

FOREIGN PATENT DOCUMENTS

| | | |
|---|---|---|
| BE | 1 012 182 | 2/2000 |
| DE | 31 36 860 | 4/1982 |
| EP | 0 062 344 | 10/1982 |
| EP | 0 272 378 | 6/1988 |
| EP | 0 275 387 | 7/1988 |

* cited by examiner

*Primary Examiner*—Gregory A Wilson
(74) *Attorney, Agent, or Firm*—Robert W. Becker; Robert W. Becker & Associates

(57) ABSTRACT

A heat exchanger for cooling reaction gas, wherein the respective ends of heat exchanger tubes, through which the reaction gas flows, are inserted in a respective tube plate and are surrounded by a jacket, at the two ends of which are provided a respective end chamber that is partially delimited by one of the tube plates and serves for the supply and withdrawal of the reaction gas; water, as cooling agent, flows through the inner chamber of the heat exchanger that is surrounded by the jacket and that is divided by a partition, extending perpendicular to the heat exchanger tubes, which extend through it, into two partial chambers disposed one after the other in the direction of flow of the reaction gas, each partial chamber being provided with its own supply connectors and outlet connectors for the cooling agent; boiling water flows through the partial chamber that is disposed on the inlet side for reaction gas and that is connected via a supply line and withdrawal lines with a water/steam drum; feed water flows through the partial chamber that is disposed on the outlet side for the reaction gas and that is connected via a withdrawal line with the water/steam drum. The partition between the two partial chambers permits the passage of the cooling agent that flows in the inner chamber of the heat exchanger.

5 Claims, 1 Drawing Sheet

HEAT EXCHANGER FOR COOLING REACTION GAS

The instant application should be granted the priority date of 24 Nov. 2006, the filing date of the corresponding German patent application DE 10 2006 055 973.8.

BACKGROUND OF THE INVENTION

The present invention relates to a heat exchanger for cooling reaction gas in an ethylene plant. Within an ethylene plant, pyrolysis or ethylene cracking or disassociation furnaces form the precursors or key components for the manufacture of the base materials ethylene, propylene, butadiene, and others for the plastics industry. Used as starting material are saturated hydrocarbons, principally ethane, propane, butane, natural gas, naphtha, or gas oil. The conversion of the saturated hydrocarbons into unsaturated hydrocarbons takes place in the cracking tubes of the cracking furnace, and in particular at inlet temperatures of 500-680° C. and discharge temperatures of 775-875° C. in a pressure range of 1.5-5 bar.

In subsequent reaction gas coolers disposed at the outlet of the cracking furnace, the unsaturated hydrocarbons, the so-called reaction gases, are cooled from 775-875° C. to approximately 350-450° C. accompanied by the formation of high and low pressure vapor. In this connection, the "cooling water" has a boiling temperature at an appropriate pressure. The cooling takes place due to the phase transition from liquid to gaseous. The steam is utilized in the ethylene plant, for example for steam turbines.

The cooling of the reaction gas, accompanied by the formation of steam, takes place either in single-stage systems, whereby the entire cooling to about 350-450° C. takes place in only a singe reaction gas cooler, or in two-stage systems, whereby a cooling is effected in stages in two reaction gas coolers that are disposed one after the other; for example, in the first stage from 875° C. to 550° C., and in a second stage from 550° C. to 350° C. The reaction gas coolers have the corresponding designation primary cooler and secondary cooler.

In addition, a further cooling of the reaction gas is effected in boiler water supply preheaters not only in the single-stage system but also in the two-stage system. Here, steam is no longer generated, rather, the "cooling water", the boiler supply water, is preheated as close as possible to the boiling temperature for the primary and secondary coolers. The supply of the preheated boiler supply water to the primary and secondary reaction gas coolers is effected indirectly via a steam drum, in which the boiler supply water is heated to the boiling temperature.

A reaction gas cooler is known from EP 0 272 378 B1 according to which the reaction gas is cooled in a first cooling stage, which represents an evaporator, by boiling water, and is cooled in a second cooling stage, which represents a superheater, by steam. As is customary, an additional cooler is disposed downstream of the reaction gas cooler in which the reaction gas is cooled down further by feed water. With a variant of the reaction gas cooler known from EP 0 272 378 B1, the evaporator and the superheater are disposed in a common casing and are separated from one another by a partition that prevents the cooling agent from flowing over from one cooling stage into the other cooling stage.

It is an object of the present invention to provide a heat exchanger for cooling reaction gas, which heat exchanger includes two partial chambers within a common jacket, in such a way that the cooling within the partial chamber disposed on the gas inlet side for the reaction gas is more effective, and that the structural buildup is reduced.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
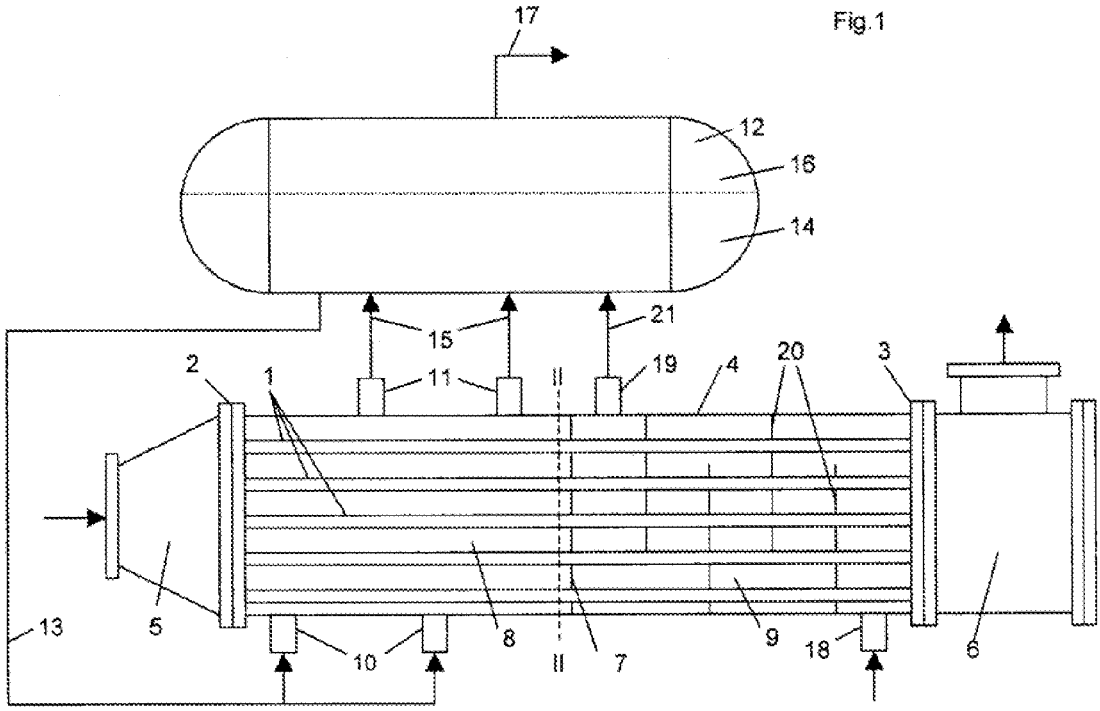
FIG. 1 is a longitudinal cross-sectional view through one exemplary embodiment of a heat exchanger for cooling reaction gas.

With the heat exchanger of the present invention, the respective ends of heat exchanger tubes, through which the reaction gas flows, are inserted in a respective tube plate and are surrounded by a jacket, at the two ends of which are provided a respective end chamber that is partially delimited by one of the tube plates and serves for the supply and withdrawal of the reaction gas; water, as cooling agent, flows through the inner chamber of the heat exchanger that is surrounded by the jacket and that is divided by a partition, extending perpendicular to the heat exchanger tubes, which extend through it, into two partial chambers disposed one after the other in the direction of flow of the reaction gas, each partial chamber being provided with its own supply connectors and outlet connectors for the cooling agent; boiling water flows through the partial chamber that is disposed on the inlet side for reaction gas and that is connected via a supply line and withdrawal lines with a water/steam drum; feed water flows through the partial chamber that is disposed on the outlet side for the reaction gas and that is connected via a withdrawal line with the water/steam drum. The partition between the two partial chambers permits the passage of the cooling agent that flows in the inner chamber of the heat exchanger.

That partial chamber of the heat exchanger disposed on the gas inlet or introduction side for the reaction gas serves as an evaporator and cools the reaction gas to nearly the boiling temperature of the boiling water. Subsequently, the reaction gas passes into the partial chamber that is disposed on the gas outlet or discharge side for the reaction gas and that serves as a preheater, where the reaction gas is further cooled by the cooler feed or supply water to significantly below the boiling temperature of water. As a result, the cooling of the reaction gas is on the whole more effective. The feed water that thereby heats up is either supplied to the steam drum, where it is heated to the boiling temperature, or it flows directly through the partition, which acts as a "leaky" tube base, into the evaporation zone. The partition, which is constructed to be intentionally penetrable or leaky for the cooling agent, provides for pressure equalization between the partial chambers.

Furthermore, by combining the evaporator and the preheater to form a common unit, the structural build-up for the reaction gas cooling is reduced by integrating the previously separate feed water preheater into the evaporator, thereby enabling a complete cooler within the cooling line, and also enabling elimination of the reaction gas line between the evaporator and the feed water preheater and shorter tube lines to the steam drum.

By dispensing with the connection from the evaporator to the preheater, the pressure losses on the gas side are eliminated that otherwise would be caused by tubular outflow from the evaporator, and tubular inflow to the preheater, as well as by the flows in the gas discharge chamber and the gas inlet chamber. As a result, the overall pressure loss of the reaction gas in the cooler is reduced, which not only increases the yield of ethylene, propylene, butadiene, and others in the reaction gas, but also lengthens the service life of the cooler.

Further specific features of the present invention will be described in detail subsequently.

DESCRIPTION OF SPECIFIC EMBODIMENTS

Referring now to the drawing in detail, the illustrated heat exchanger serves for the cooling of reaction gas in an ethylene plant. The heat exchanger is comprised of a tube bundle of straight heat exchanger tubes 1, which are held in respective tube plates 2, 3 at both ends of the tube bundle. In the drawing, only a few of the heat exchanger tubes 1 are shown to facilitate illustration. Bores extend through each of the tube plates 2, 3; one of the heat exchanger tubes 1 is inserted into each of the bores and is welded to the tube plates 2, 3 via a weld seam. The tube bundle is surrounded by an external jacket or shell 4, which together with the respective tube plates 2, 3 delimits an inner chamber through which flows a coolant or cooling agent.

Respectively adjoining the tube plates 2, 3 on the gas introduction side and on the gas discharge side is an end chamber, namely the inlet chamber 5 and the discharge chamber 6. Each of the inlet chamber 5 and discharge chamber 6 is provided with a connector for the supply or withdrawal of the reaction gas. All of the components of the heat exchanger are made of steel having good high-temperature characteristics.

The hot reaction gas that is supplied through the inlet chamber 5 encounters the tube plate 2, flows through the bores of the tube plate 2 into the heat exchanger tubes 1, and leaves through the tube plate 3 at the other end of the cooled zone of the heat exchanger. The cooled reaction gas is withdrawn via the discharge chamber 6. The arrows illustrated indicate the direction of flow.

The inner chamber of the heat exchanger is divided by a partition 7 into two partial chambers 8, 9, so that within the heat exchanger two cooling zones result, each of which is supplied with its own cooling agent and serves as an evaporation zone or as a preheating zone respectively.

The heat exchanger is horizontally disposed and the underside of the partial chamber 8, which is disposed on the gas inlet side for the reaction gas, is provided with a plurality of supply connectors 10 for a cooling agent, while the upper side is provided with a plurality of outlet connectors 11 for the cooling agent. Boiling water that is under high pressure serves as the cooling agent; the water is supplied to a water/steam drum 12 that serves for the separation of water and steam. For this purpose, connected to the supply connectors 10 is a supply line 13 that proceeds from the water chamber 14 of the water/steam drum 12. The outlet connectors 11 are connected to the withdrawal lines 15, which empty into the water chamber 14 of the water/steam drum 12 at a different location, and withdraw the saturated steam that is produced in the heat exchange with the reaction gas. The steam that is separated off in the water/steam drum 12 is withdrawn via a steam line 17 that proceeds from the steam chamber 16 of the water/steam drum 12.

The underside of the partial chamber 9 of the horizontally disposed heat exchanger disposed on the gas discharge side is provided with one or more supply connectors 18 in the vicinity of the tube plate or base 3, while the upper side of the partial chamber 9 is provided with one or more outlet connectors 19 in the vicinity of the partition 7. Feed water is fed into the partial chamber 9 via the supply connectors 18. Disposed in the partial chamber 9 are guide plates 20, which are spaced from and parallel to one another, and are offset at the bottom and the top relative to one another. The guide plates 20 act as baffle plates and guide the feed water through the partial chamber 9 in a counter current stream to the reaction gas. In the heat exchange with the reaction gas, the feed water is preheated and is conveyed into the water chamber 14 of the water/steam drum 12 via a withdrawal line 21 that is connected to the outlet connector 19.

Combining an evaporation zone and a preheating zone to form a cooperative heat exchanger unit shortens the supply and withdrawal means between the heat exchanger and the water/steam drum 12. The arrangement of the present application makes it possible to mount the water/steam drum 12 directly on the jacket 4 of the heat exchanger. This results in a compact structural unit, by means of which the tube lines as well as assembly times can be reduced.

Figure 2:
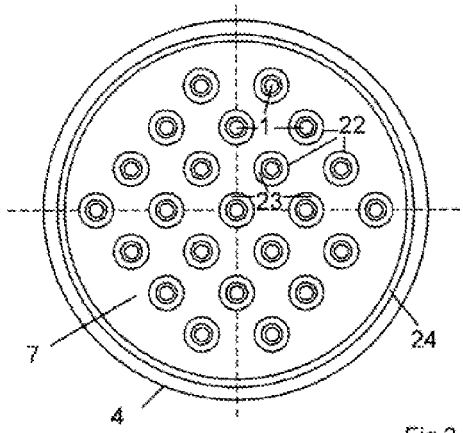
FIG. 2 is a cross-sectional view taken along the line II-II in FIG. 1.

The partition 7 between the two partial chambers 8, 9 is a non load-bearing component that merely has the task of keeping the flows in the partial chambers 8, 9 separated. The partition 7 is provided with bores 22, the diameter of which is slightly greater than the outer diameter of the heat exchanger tubes 1, so that the heat exchanger tubes 1 are guided through the partition 7 with play or clearance 23. The outer diameter of the partition 7 is less than the inner diameter of the jacket 4, so that in the installed state a gap 24 results between the partition 7 and the jacket 4. The partition 7 can be inserted into the jacket 4 together with the tube bundle comprised of the heat exchanger tubes 1. With a normal-size heat exchanger, the gap 24 between the partition 7 and the jacket 4 is only a few millimeters, for example 2 mm, and the clearance 23 between the heat exchanger tubes 1 and the bores 22 in the partition 7 is less than 1 mm, e.g. 0.6 mm. In FIG. 2, for illustration purposes the gap 24 and the clearance 23 are shown oversized.

The effect of the gap 24 between the partition 7 and the jacket 4, as well as of the clearance 23 between the periphery of the heat exchanger tubes 1 and the bores 22 in the partition 7, is that the partition 7 permits passage of the respective cooling agent from one of the partial chambers 8, 9 into the other. The partition 7 thus acts like a "leaky" tube base.

The feed water is supplied to the partial chamber 9 disposed on the gas outlet side via pumps, and is under a pressure that, however, is slightly variable or always greater than the pressure in the partial chamber 8 disposed on the gas inlet side. There thus generally always exists a pressure differential. This pressure differential is compensated for in that water passes out of the partial chamber 9 disposed on the gas outlet side through the intentionally unsealed partition 7 into the partial chamber 8 disposed on the gas inlet side. The leakage water exiting from the partial chamber 9 disposed on the gas outlet side evaporates in the partial chamber 8 disposed on the gas inlet side and also passes into the water/steam drum 12.

The specification incorporates by reference the disclosure of German priority document DE 10 2006 055 973.8 filed 24 Nov. 2006.

The present invention is, of course, in no way restricted to the specific disclosure of the specification and drawing, but also encompasses any modifications within the scope of the appended claims.

What I claim is:

1. A heat exchanger for cooling reaction gas in an ethylene plant, comprising:

two tube plates;

heat exchanger tubes through which reaction gas is adapted to flow, wherein ends of said heat exchanger tubes are inserted in respective ones of said tube plates;

a jacket surrounding said heat exchanger tubes to form an inner chamber delimited by said tube plates, wherein end chambers adjoin said tube plates for supply of the reaction gas to and withdrawal of the reaction gas from said inner chamber, and wherein water, as cooling agent, is adapted to flow through said inner chamber;

a partition disposed in said inner chamber and extending perpendicular to said heat exchangers tubes, wherein said heat exchanger tubes extend through said partition, further wherein said partition divides said inner chamber into two partial chambers that are disposed one after the other in a direction of flow of the reaction gas, further wherein each of said partial chambers is provided with respective supply connectors and outlet connectors for the cooling agent, and wherein said partition allows cooling agent to pass between said partial chambers; and a water/steam drum, wherein a first one of said partial chambers is disposed on a gas inlet side for the reaction gas and is connected via said outlet connectors and withdrawal lines to said water/steam drum, further wherein said first partial chamber is adapted to receive boiling water from said water/steam drum via a supply line and said supply connectors, further wherein said boiling water is adapted to flow through said first partial chamber to said outlet connectors thereof, further wherein a second one of said partial chambers is disposed on a gas discharge side for the reaction gas and is connected via said outlet connector and a withdrawal line with said water/steam drum, and wherein said second partial chamber is adapted to receive feed water via said supply connector, wherein said feed water is adapted to flow through said second partial chamber to said outlet connector thereof.

2. A heat exchanger according to claim 1, wherein a pressure of said feed water in said second partial chamber is greater than a pressure of said boiling water in said first partial chamber.

3. A heat exchanger according to claim 1, wherein said partition is embodied as a non load-bearing component.

4. A heat exchanger according to claim 1, wherein a gap is provided between an outer periphery of said partition and an inner surface of said jacket.

5. A heat exchanger according to claim 1, wherein said partition is provided with bores and wherein said heat exchanger tubes extend through said bores of said partition with clearance.

* * * * *